United States Patent [19]

Sayers

[11] Patent Number: 4,960,214

[45] Date of Patent: Oct. 2, 1990

[54] CASSETTE STORAGE BASKET

[75] Inventor: Richard C. Sayers, Opelika, Ala.

[73] Assignee: Ampex Corproation, Redwood City, Calif.

[21] Appl. No.: 243,355

[22] Filed: Sep. 12, 1988

[51] Int. Cl.[5] ..... A47F 7/00

[52] U.S. Cl. ..... 211/133; 211/41; 211/181

[58] Field of Search ..... 211/133, 106, 181, 128, 211/187, 94, 162, 41, 71, 126; 280/79.3

[56] References Cited

U.S. PATENT DOCUMENTS

| | | | |
|---|---|---|---|
| 186,254 | 9/1959 | Tirlet | 211/181 |
| 3,595,404 | 7/1971 | Goldstein | 211/133 X |
| 3,951,097 | 10/1975 | Young, Jr. | 211/187 X |
| 4,248,352 | 2/1981 | White | 211/106 X |
| 4,299,327 | 11/1981 | Thauer | 211/181 X |
| 4,813,535 | 3/1989 | Radocha et al. | 211/133 X |

*Primary Examiner*—Alvin C. Chin-Shue
*Assistant Examiner*—Sarah A. Lechok
*Attorney, Agent, or Firm*—D. M. Gilbert; H. G. Thibault

[57] ABSTRACT

A cassette storage basket configured for mounting on a rack mounted storage system. A wire-form basket includes an open front defined by a rectangular frame, with the frame rearwardly tilted to give the basket a triangular profile. A rear wall of the basket incorporates at least one upper hook and a rearwardly extending lower abutment to tilt the bottom of the rack-mounted basket from the horizontal to protect cassettes stored in the basket during transport.

6 Claims, 4 Drawing Sheets

CASSETTE STORAGE BASKET

The present invention pertains to magnetic tape storage systems generally and in particular, to the cassette storage basket used in a cassette storage system.

The use of video tape and video tape cassettes in a television production setting or post-production setting is considerable. To bring some significant level of order to this proliferation of magnetic tape is an absolute necessity in any production or post-production facility. Tape must be stored in libraries and must also be available for orderly transfer to other smaller storage areas such as recording areas, editing areas, or the like. Accordingly, a versatile storage system is a must.

However, prior to the present invention, a storage system usable for a library setting was not adaptable to a rolling storage system, nor was a rolling storage system adaptable for use in a minimal storage area such as a single office or an editing room. The magnetic cassette storage system of the present invention offers a versatility heretofore unknown.

The system employs a multi-purpose storage rack which can be easily used in a library setting to provide an array of successive wall-mounted racks, such racks uniquely configured to provide minimal spacing between individual racks, as well as to provide a unitary alignment for the storage rails mounted on the racks and associated with the array. Such racks may be mounted equally as well on the supporting frame of a mobile cart as they are mounted on a wall space. The structure of the rack and the advantages provided by it are discussed at considerable length in a related patent application.

The present invention provides a unique wire-form cassette storage basket particularly adapted for use with the storage rack described above. The cassette storage basket of the present invention has a unique construction which includes an open front face for receiving cassettes, connected rear and bottom support walls, engaging hooks extending rearwardly from an upper end of the rear support wall of the basket to engage an associated first or upper storage rail of the rack, and a basket support elbow disposed at a lower end of the rear wall, with the support elbow sufficiently displaced vertically from the engaging hooks to engage a second or lower rail of the storage rack, to incline the basket outwardly from the rack and upwardly from the horizontal to minimize spilling of the cassettes from the basket.

Further, the basket itself can serve as a separate, smaller storage unit, easily carried by separate handles provided in opposite side rails of the basket, with the rear and bottom walls oriented to dispose the cassettes in a horizontal position when the basket is rested on a flat surface. The wire-form cassette storage basket also incorporates a unique bottom structure which provides additional support to cassettes stored in the basket and prevents them from falling from the basket during transport.

These advantages, as well as others not noted here, should become readily apparent upon consideration of the detailed description of the present invention as set forth below, particularly if the detailed description is considered with the accompanying drawings described below.

DETAILED DESCRIPTION OF THE INVENTION

Figure 1:
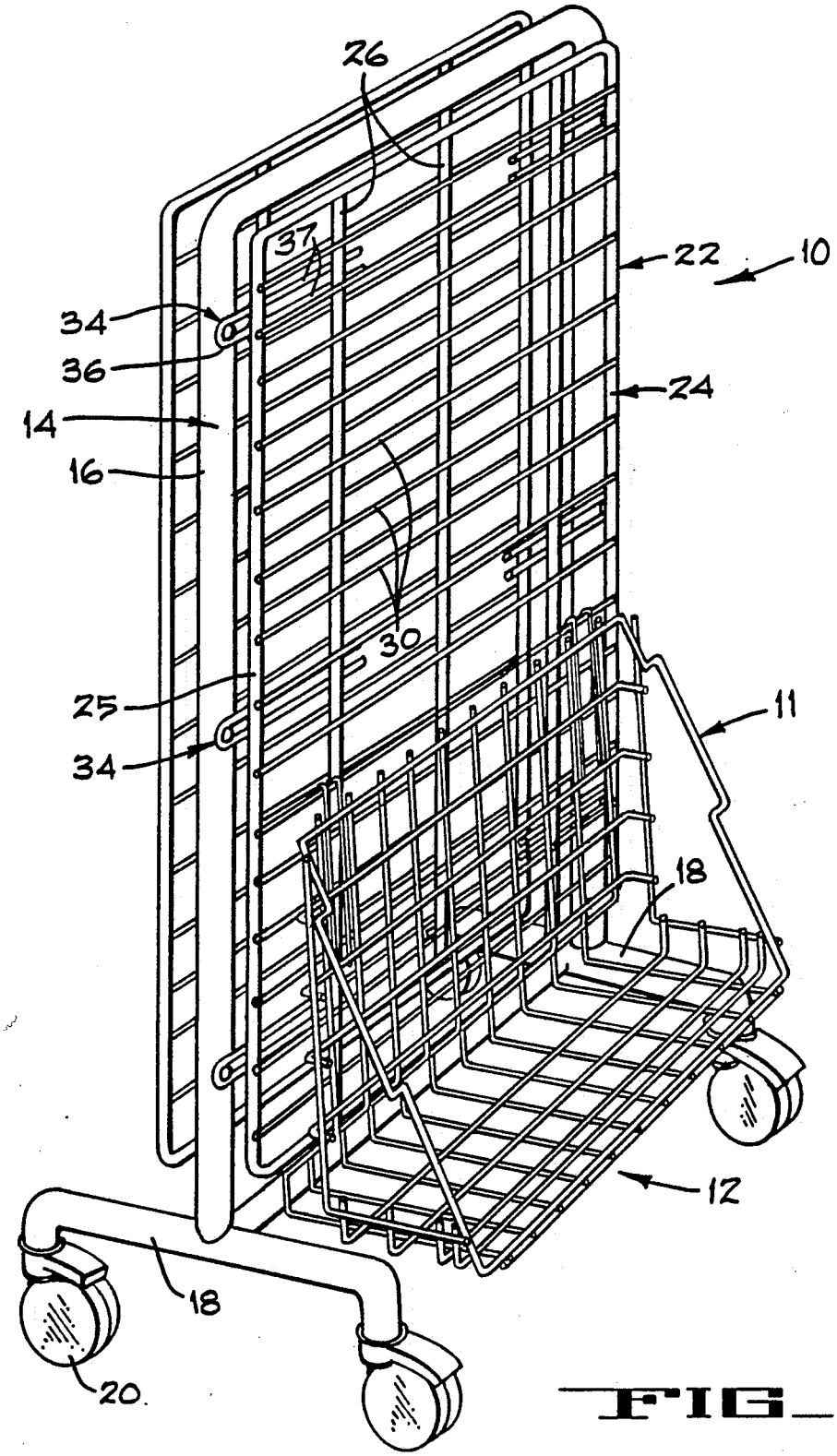
FIG. 1 is a perspective view of a mobile cart incorporating the cart-mounted storage system of the present invention.
Figure 2:
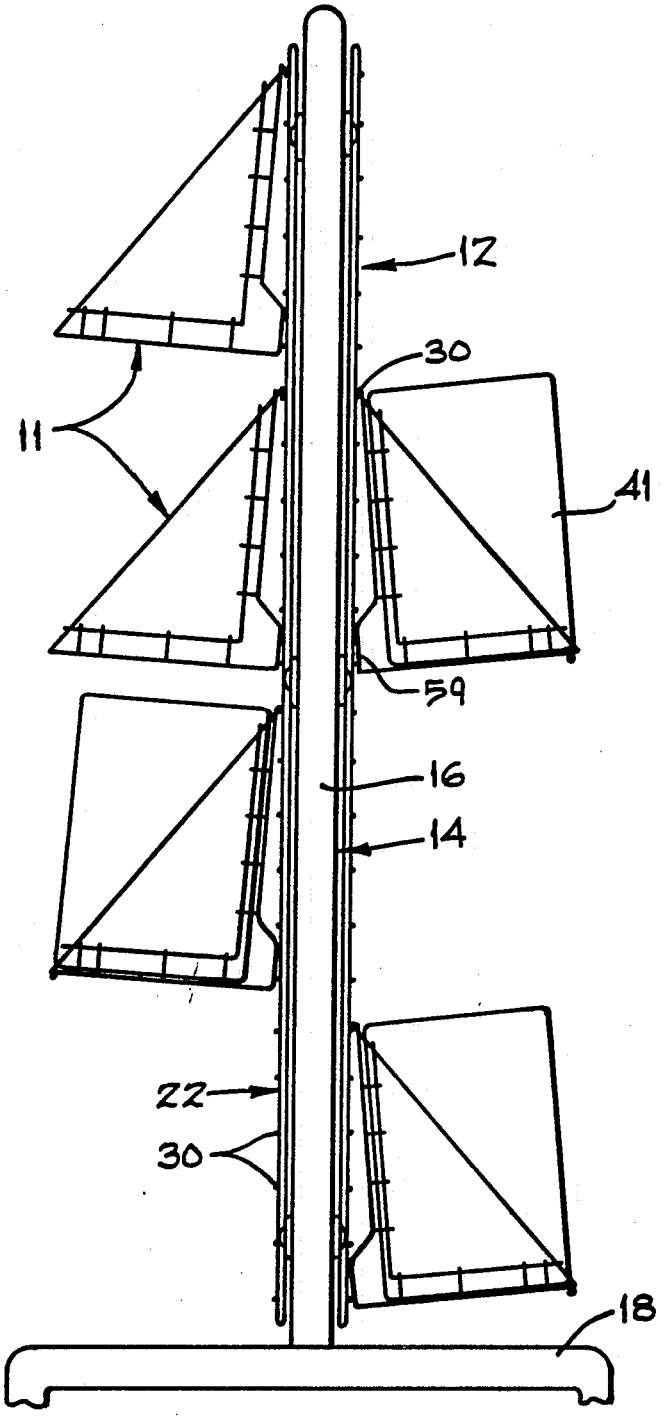
FIG. 2 is a side elevation of the cart of FIG. 1 with additional cassette storage baskets of the present invention mounted on the racks provided on opposite sides of the cart and with cassettes stored in the basket.

As best seen in FIGS. 1 and 2 the storage system 10, incorporating the cassette storage basket 11 of the present invention, includes a mobile cart 12 comprising a generally rectangular tubular frame 14 having opposite side rails 16 each mounted on a bottom support rail 18. Each bottom support rail 18 includes casters or similar rolling support members 20 at opposite ends of the support rails 18.

Mounted on the frame 14 is a storage rack 22. The rack 22 is a relatively heavy structure and designed to insure substantial rigidity. The rack 22 is generally rectangular to conform to the shape of the frame 14 of the cart 12. The periphery of the rack 22 is defined by a relatively heavy rod or wire about ¼" in diameter which forms the rectangular outer frame or support rail 24 of the rack 22. Vertical support posts 26, generally of the same diameter as the outer frame 24, are suitably secured between the top and bottom of frame 24 to extend therebetween in generally parallel, equi-spaced alignment, to be suitably fastened in place, as by welding.

To complete the grid of the rack 22, storage rails 30, of somewhat smaller diameter than the posts 26, are disposed in parallel, equi-spaced, generally horizontal alignment across the face of the rack 22, and suitably secured, as by welding, to side rails 25 of the outer support rail 24 and to the vertical support posts 26.

Completing the rack 22 are a series of side mounting brackets 34 secured to the side rails 25 of frame 24. Each mounting bracket 34 consists of a loop 36 formed of a single wire generally of the same diameter as the diameter of the wire forming the side rails 25 of the frame 22. The loop 36 is closed by the side rail 25 with inwardly extending top and bottom legs or wires 37 of the loop 36 mounted behind the side rail 25 to extend inwardly to engage a support post 26 and to also be secured behind the post 26. Suitable fasteners, attached at the brackets 34, secure the rack 22 to the frame 14.

A plurality of storage baskets 11 are mounted on the cart 12, each basket 11 capable of receiving a plurality of video tape cassettes 41 of various sizes. Although the cassette basket 11 may be of varying sizes, its inventive features are not limited by dimension, and the description of a single basket will suffice as a description for all baskets.

Figure 3:
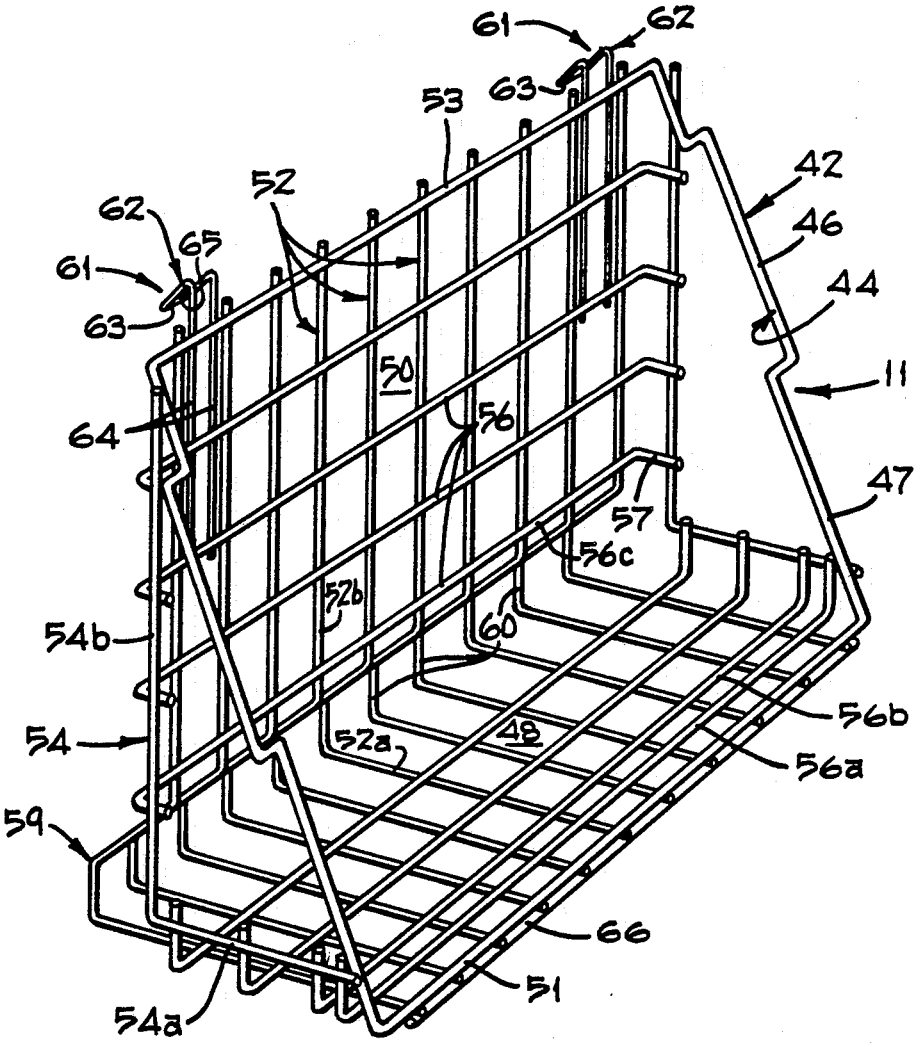
FIG. 3 is a right front perspective view of one of the cassettes storage baskets mounted on the cart of FIGS. 1 and 2.

A cassette storage basket 11 (FIG. 3) comprises a four-sided wire-form structure 42. The storage basket 11 extends rearwardly from an open front defined by a generally rectangular front frame 44. The front frame 44 includes handles 46 projecting outwardly from opposite shorter side rails 47 of the frame 44. Bottom wall 48 and rear wall 50 are connected to the frame 44 to form the basket 11.

Interconnected bottom and rear walls 48, 50 of the basket 11 include a first plurality of generally L-shaped wires 52, each having a base leg **52*a* and an upper leg 52*b*, the wires 52 placed in equi-spaced, generally parallel alignment from one side of the frame 44 to the other, with the front end of each forwardly projecting base leg 52*a* attached to a bottom rail 51 of the frame 44, and the top of each upper leg 52*b* attached to a top rail 53 of the frame 44. The wires 52 are connected behind the frame 44. In the resulting structure, the frame 44 is tilted rearwardly at the top thereof, to give the basket 11** a triangular profile.

To further stabilize the basket 11, an L-shaped brace 54 is attached on the outside of each side rail 47 of the frame 44 to define opposite side walls of the basket 11. Each brace 54 includes a base leg **54*a* and an upper leg 54*b*, with the front end of each base leg 54*a* attached to a respective side rail 47 of the frame 44 near the bottom thereof and an upper end of each upper leg 54*b* attached an upper end of each side rail 47**.

To complete the grid-like structure of bottom and rear walls 48, 50, longitudinal wires 56 are connected between the side braces 54 as follows. The respective bottom and upper legs **54*a*, 54*b* of each side brace 54 are displaced inwardly from the bottom and upper legs 52*a*, 52*b* of the wires 52. Each wire 56 has opposite bent outer ends 57, which outer ends 57 are connected to the inside of each brace 54, with the longitudinal body portion of each wire 56 attached to the inside of each wire 52** at the respective intersections thereof.

For bottom wall 48, generally parallel wires 56 are not equi-spaced. Wires **56*a*, 56*b*, at the front of bottom wall 48, are less than an inch apart, to engage and support the front ends of cassettes 41 stored in the basket 11, to prevent spillage of cassettes during transport. The remaining wires 56 forming the grid of bottom wall 48 have a spacing comparable to the spacing for the wires 52**.

Rear wall 50 includes a rear abutment 59, defined by a plurality of rearwardly extending projections 60 provided at the bottom of each upper leg **52*b* of each wire 52. A bottom, horizontally disposed wire 56*c* of rear wall 50 is disposed slightly above the abutment 59, with additional wires 56 disposed above the wire 56*c* in generally parallel, equi-spaced alignment, to complete the grid forming the rear wall 50**.

The structure of the rear wall 50 of the basket 11 is completed by a pair of hooks 61 mounted at the top of the rear wall 50, at opposite ends thereof. Each hook 61 is a generally U-shaped member 62, having a base 63 and outer legs 64. Legs 64 of the member 62 are bent near the ends adjacent the base 63, to form hook portion 65. Each hook 61 is attached behind the rear wall 50 of the basket 11 with its U-shaped member 62 inverted to have the hook portion 65 disposed above the top of the frame 44 and extending rearwardly, with its outer legs 64 attached behind both the top rail 53 of the frame 44 and the next adjacent pair of horizontal wires 56 of the rear wall 50. A reinforcing rail 66 is attached at the front of bottom legs **52*a*, at the bottom thereof, to sandwich the ends of legs 52*a* between the bottom rail 51 and the rail 66, to give increased rigidity to bottom wall 48**.

When the basket 11 is mounted on the rack 22 the engaging hooks 61 engage a first, upper storage rail 30, with the rear abutment 59 engaging at least one lower storage rail 30. Rails 30 are equally spaced on the rack 22 and the rear abutment 59 of the basket 11 is configured to engage at least one of an adjacent pair of rails 30 to project the bottom of the basket 11 outwardly of the rack 22 and also to tilt the basket 11 upwardly from the horizontal to prevent cassettes 41 stored therein from easily spilling out of the basket 11 during transport. Note that although larger cassette storage baskets will have longer bottom and rear walls, rear abutment 59 need only be long enough to extend between an adjacent pair of storage rails 30 to urge the basket 11 away from the rack 22.

Figure 4:
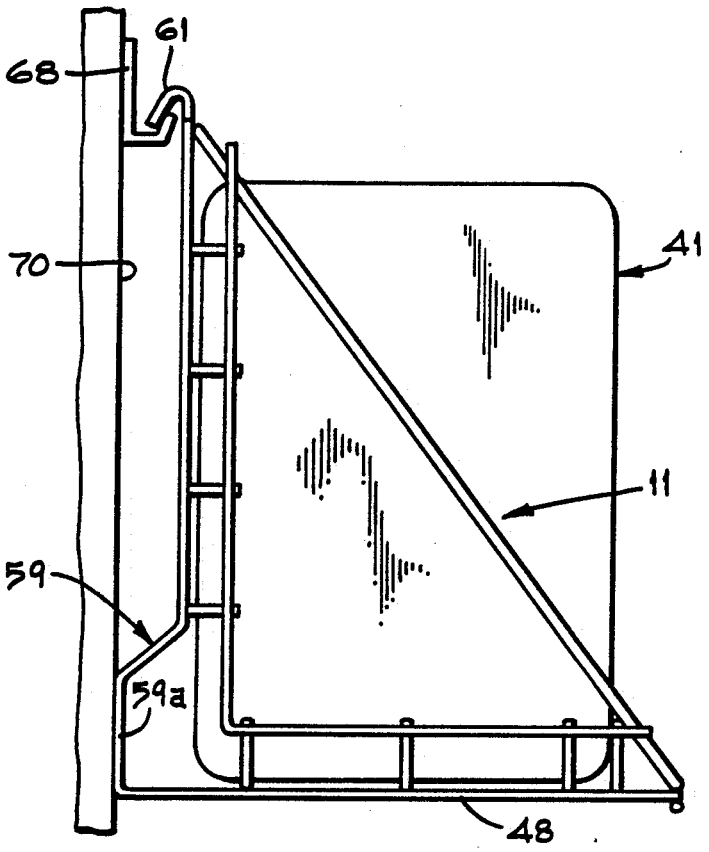
FIG. 4 is a side elevation of the basket of FIG. 3 hooked to a wall-mounted rail.

As seen in FIG. 4, the basic configuration of the basket 11 is readily adaptable for use with structures other than the rack 22. For example, a single wall-mounted rail 68 can receive the upper engaging hooks 61 of the basket 11 with the rear abutment 59 engaging a wall 70 supporting the rail 68. In this configuration a rearwardly projecting edge **59*a* of the abutment 59 is flush with the wall 70 to dispose the basket 11 with its bottom wall 48** in a generally horizontal orientation.

Also the basket 11 can be used as its own portable storage unit. The rear wall 50 interfaces with the bottom wall 48 to dispose the bottom wall 48 in a generally horizontal orientation, when the basket 11 is set on a flat surface.

The description of the preferred embodiment of the present invention can encompass similar configurations of a cassette storage basket which have not been detailed here. Therefore the scope of the present invention is best defined in terms of the appended claims.

What is claimed is:

1. A cassette storage basket, suitable for carrying a plurality of cassettes, and mountable on a complementary storage hanger provided on a fixed hanger support member, the basket comprising:

a support frame open at the front for receiving cassettes, with a bottom wall, an interconnected rear wall, and side brackets at respective ends of the walls connected to the support frame to define the framework of the basket;

the support frame comprising a rectangular frame defining the open front of the basket with handles provided in the frame at the sides thereof, at least one hook provided at an upper end of the rear wall; and at least one rearwardly extending abutment mounted at a lower end of the rear wall, with the engagement of the hooked portion with a complementary storage hanger and the engagement of the elbow portion with the hanger support member maintaining the basket in at least a horizontal orientation.

2. A cassette storage basket, suitable for carrying a plurality of cassettes, and mountable on a complementary storage hanger provided on a fixed hanger support member, the basket comprising:

a support frame open at the front for receiving cassettes, with a bottom wall, an interconnected rear wall, and side brackets at respective ends of the walls connected to the support frame to define the framework of the basket;

the bottom and rear walls of the frame being defined by a series of L-shaped wires with each wire having a first bottom leg connected at the front thereof under the bottom of the support frame and a rear leg connected at the top thereof behind the top of the support frame, the L-shaped wires disposed from one side of the frame to the other in a generally parallel equi-spaced array, the L-shaped wires including a rearwardly projecting abutment provided at the bottom of the rear leg of each wire, at least one hook provided at an upper end of the rear wall; and at least one rearwardly extending abutment mounted at a lower end of the rear wall, with the engagement of the hooked portion with a complementary storage hanger and the engagement of the elbow portion with the hanger support member maintaining the basket in at least a horizontal orientation.

3. A cassette storage basket suitable for carrying a plurality of cassettes, and mountable on a complementary storage hanger provided on a fixed hanger support member, the basket comprising:

a support frame open at the front for receiving cassettes, with a bottom wall, an interconnected rear wall, and side brackets at respective ends of the walls connected to the support frame to define the framework of the basket;

the support frame including side rails and each side rail having attached thereto an l-shaped side brace, each side brace having a front portion of the bottom leg attached to the lower end of the side rail and an upper portion of its rear leg attached near the top of the side rail, the bottom and rear walls of the frame being defined by a series of L-shaped wires with each wire having a first bottom leg connected at the front thereof under the bottom of the support frame and a rear leg connected at the top thereof behind the top of the support frame, the L-shaped wires disposed from one side of the frame to the other in a generally parallel equi-spaced array, at least one hook provided at an upper end of the rear wall; and at least one rearwardly extending abutment mounted at a lower end of the rear wall, with the engagement of the hooked portion with a complementary storage hanger and the engagement of the elbow portion with the hanger support member maintaining the basket in at least a horizontal orientation.

4. A cassette basket suitable for carrying a plurality of cassettes, and mountable on a complementary storage hanger provided on a fixed hanger support member, the basket comprising:

a support frame open at the front for receiving cassettes, with a bottom wall, an interconnected rear wall, and side brackets at respective ends of the walls connected to the support frame to define the framework of the basket;

the bottom and rear walls of the frame being defined by a series of L-shaped wires with each wire having a first bottom leg connected at the front thereof under the bottom of the support frame and a rear leg connected at the top thereof behind the top of the support frame, the L-shaped wires disposed from one side of the frame to the other in a generally parallel equi-spaced array, longitudinal wires being connected between opposite side braces of the support frame and connected at the intersection of the longitudinal wires and the L-shaped wires with the L-shaped wires and the longitudinal wires defining respective grids for the bottom and rear walls of the basket, at least one hook provided at an upper end of the rear wall; and at least one rearwardly extending abutment mounted at a lower end of the rear wall, with the engagement of the hooked portion with a complementary storage hanger and the engagement of the elbow portion with the hanger support member maintaining the basket in at least a horizontal orientation.

5. A cassette storage basket suitable for carrying a plurality of cassettes, and mountable on a complementary storage hanger provided on a fixed hanger support member, the basket comprising:

a support frame open at the front for receiving cassettes, with a bottom wall, an interconnected rear wall, and side brackets at respective ends of the walls connected to the support frame to define the framework of the basket;

a foremost pair of longitudinal wires of the bottom wall being spaced closer together than the rest of the wires forming the grid of the bottom wall to prevent cassettes stored in the storage basket from falling from the basket during transport, at least one hook provided at an upper end of the rear wall; and at least one rearwardly extending abutment mounted at a lower end of the rear wall, with the engagement of the hooked portion with a complementary storage hanger and the engagement of the elbow portion with the hanger support member maintaining the basket in at least a horizontal orientation.

6. A cassette storage basket suitable for carrying a plurality of cassettes, and mountable on a complementary storage hanger provided on a fixed hanger support member, the basket comprising:

a support frame open at the front for receiving cassettes, with a bottom wall, an interconnected rear wall, and side brackets at respective ends of the walls connected to the support frame to define the framework of the basket;

a foremost pair of longitudinal wires of the bottom wall being spaced closer together than the rest of the wires forming the grid of the bottom wall to prevent cassettes stored in the storage basket from falling from the basket during transport, at least one hook provided at an upper end of the rear wall;

the hook comprising a U-shaped member having a base and two outer legs, with the U-shaped member bent near the base to form a hook portion, a pair of hooks mounted at opposite ends of the rear wall at the top thereof, with the hook attached behind the rear wall, with the hook portion extending rearwardly and disposed above the top of the rear wall, and at least one rearwardly extending abutment mounted at a lower end of the rear wall, with the engagement of the hooked portion with a complementary storage hanger and the engagement of the elbow portion with the hanger support member maintaining the basket in at least a horizontal orientation.

* * * * *